US006099936A

United States Patent [19]

Kashihara

[11] Patent Number: 6,099,936

[45] Date of Patent: Aug. 8, 2000

[54] SLIP STOP RUBBER SHEET AND SLIP-STOP RUBBER SHEET LINED WORK GLOVES

[75] Inventor: Tatsuo Kashihara, Hiroshima, Japan

[73] Assignee: Atom Corporation, Hiroshima, Japan

[21] Appl. No.: 08/877,496

[22] Filed: Jun. 17, 1997

[30] Foreign Application Priority Data

Jul. 5, 1996 [JP] Japan ..... 8-195450

[51] Int. Cl.[7] ..... B32B 3/00; A41D 19/00

[52] U.S. Cl. ..... 428/141; 428/156; 428/172; 428/195; 428/213; 2/159; 2/161.6; 2/161.8; 2/168; 2/169

[58] Field of Search ..... 428/156, 172, 428/192, 141, 213, 195, 492, 409; 2/159, 161.6, 161.8, 168, 169

[56] References Cited

U.S. PATENT DOCUMENTS

| | | | |
|---|---|---|---|
| 5,055,340 | 10/1991 | Matsumura et al. | 428/172 |
| 5,524,575 | 6/1996 | Lennon | 119/83 |
| 5,676,092 | 11/1997 | Ortolivo | 119/650 |

FOREIGN PATENT DOCUMENTS

| | | |
|---|---|---|
| 93 08 338 | 8/1993 | Germany . |
| WO 95/25428 | 9/1995 | WIPO . |

OTHER PUBLICATIONS

"Hyper Grips" brochure, 4 pages, published May 31, 1992 by ATOM Corporation, Hiroshima, Japan.

*Primary Examiner*—Donald Loney
*Attorney, Agent, or Firm*—Frishauf, Holtz, Goodman, Langer & Chick, P.C.

[57] ABSTRACT

A slip-stop rubber sheet having a plurality of thin rubber pieces formed on a surface of a rubber laminated layer in an XY plane at an appointed interval in the Y direction, wherein the thin rubber pieces are erected in a plurality of rows such that the thin rubber pieces extend so as to roughly constitute waveforms in the X direction and such that the thin rubber pieces are bendable in the Y direction. A slip-stop rubber sheet lined work glove is formed by pressure-fitting the slip-stop rubber sheet onto a palmar surface of a glove in such a manner that the X direction of the slip-stop rubber sheet is made coincident with a cross direction parallel with a width direction of a palmar width of the glove.

10 Claims, 4 Drawing Sheets

SLIP STOP RUBBER SHEET AND SLIP-STOP RUBBER SHEET LINED WORK GLOVES

FIELD OF THE INVENTION

The present invention relates to a slip-stop rubber sheet and slip-stop rubber sheet lined work gloves.

BACKGROUND OF THE INVENTION

Slip-stop applied work gloves, for example, rubber-lined gloves, are conventionally formed in such a manner that a rubber laminated layer on which a number of convex and concave patterns made of non-vulcanized rubber are formed is pressure-fit to the palmar surface of knitted gloves, and the rubber is vulcanized by a heat treatment, wherein the rubber laminated layer is pressure-fit two or three times onto the finger tops in order to secure the strength thereof.

Although such rubber-lined work gloves are suitable for heavy work such as in civil engineering and building construction, metal work, forest work, etc., they are not suitable for general light work, for example, do-it-yourself home improvement and gardening. That is, since the rubber-lined gloves usually have a thickness of 0.9 mm to 1.1 mm as a rubber lining, there is such a problem in that the flexibility is not sufficient for general light work, and in that the gloves are difficult to use.

SUMMARY OF THE INVENTION

It is therefore an object of the present invention to provide work gloves which are lined with a thin slip-stop rubber sheet, have a sufficient flexibility and are easy to use.

In order to achieve the above object, a slip-stop rubber sheet (10) according to the invention is characterized in that rows (3) of a plurality of thin rubber pieces (2) are formed on the surface of a rubber laminated layer (1), in an XY plane, at an appointed interval in the Y direction with said rubber pieces (2) erected in a plurality of rows (3*a*, 3*b*, 3*c*, 3*d*, . . . ) so that the rubber pieces extend so as to roughly constitute waveforms in the X direction, and said erected rubber pieces are bendable in the Y direction.

Slip-stop rubber sheet lined work gloves according to the invention are characterized in that rows (3) of a plurality of thin rubber pieces (2) are formed on the surface of a rubber laminated layer (1), in an the XY plane, at an appointed interval in the Y direction with said rubber pieces (2) erected in a plurality of rows (3*a*, 3*b*, 3*c*, 3*d*, . . . ) so that the rubber pieces extend so as to roughly constitute waveforms in the X direction, and a slip-stop rubber sheet (10) in which said erected rubber pieces (2) are bendable in the Y direction is pressure-fit onto the palmar surface of gloves and formed thereon in such a manner that the X direction of said slip-stop rubber sheet (10) is made coincident with the cross direction parallel with the width direction of the palmar width (L) of the gloves.

In the above description, the reference numbers in parentheses correspond to the same reference numbers of parts and elements referred to in the description of the preferred embodiment of the invention set forth herein below.

In addition, as used herein, "pressure-fit" means that gum may be impregnated into the textile of the gloves without the use of any adhesive agent or that the same may be lined with an adhesive agent.

With a slip-stop rubber sheet (10) according to the invention, since the rubber pieces erected on the surface of a rubber laminated layer are bendable in the Y direction, the rubber pieces are bent in the other direction if a force acts on the same from one direction, whereby convex and concave surfaces are formed to accomplish a slip-stop effect.

Furthermore, with the slip-stop rubber sheet lined work gloves according to the invention, the abovementioned slip-stop rubber sheet pressure-fit onto the palmar surface is attached in such a manner that the X direction of the slip-stop rubber sheet is made coincident with the direction parallel to the palm width direction of gloves, that is, the cross direction of the gloves. Therefore, since the X direction of the slip-stop rubber sheet is made coincident with the bending direction of a hand of a user (worker) wearing the gloves, there is less resistance when bending the hand.

Furthermore, since rows of a plurality of rubber pieces which will act as slip stoppers are erected on the surface of the rubber laminated layer of a slip-stop rubber sheet as described above, an excellent slip-stop function is able to be fully displayed even though the thickness of the rubber laminated layer is only about 0.45 mm which is about half the conventional thickness.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
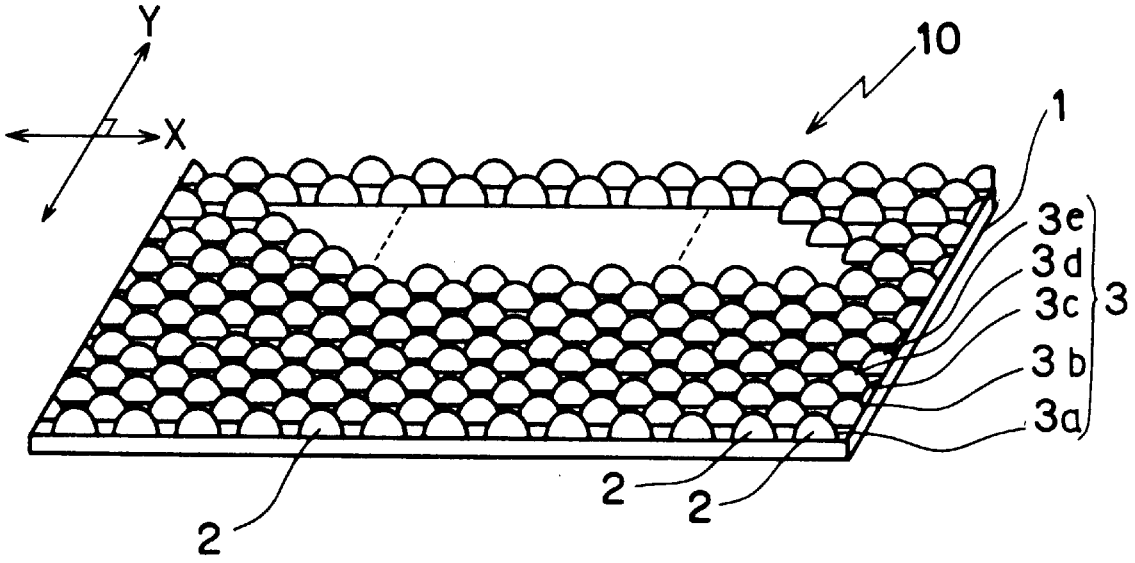
FIG. 1 is a perspective view showing the appearance of a slip-stop rubber sheet according to a preferred embodiment of the invention.
Figure 2:
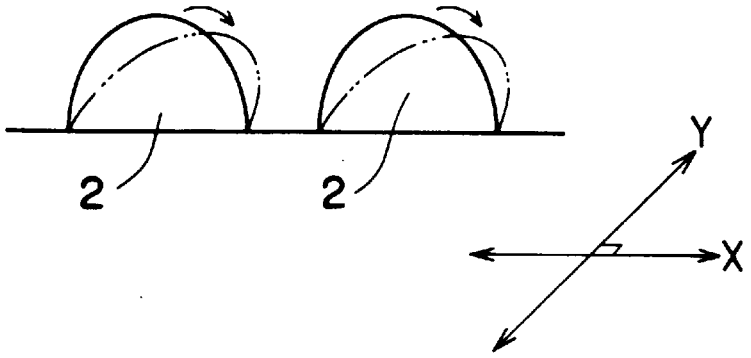
FIG. 2 is an enlarged perspective view showing rubber pieces 2 of FIG. 1.

A description is given of a preferred embodiment of the invention with reference to the drawings attached herewith, wherein FIG. 1 is a perspective view showing the appearance of a slip-stop rubber sheet 10 according to the preferred embodiment of the invention.

A slip-stop rubber sheet 10 according to the preferred embodiment is such that a plurality of thin rubber pieces 2 extending so that they constitute rough wave forms in the X direction are erected and formed on the surface of a rubber laminated layer 1, in an XY plane, in a plurality of rows 3*a*, 3*b*, 3*c*, 3*d*, . . . at an appointed interval in the Y direction.

Furthermore, since the erected rubber pieces 2 are thin in the Y direction, they are bendable in the same direction, whereby if they are subject to a force from any one of the sides in the Y direction, they are bent in the other side to cause the convex and concave surfaces to be formed. As a result, a slip-stop effect can be produced.

Still further, rows 3 of a plurality of thin rubber pieces 2 erected on the surface of the rubber laminated layer 1 are formed in such a manner that a rubber laminated layer 1 is placed on the lower mold (not illustrated) and the upper mold (not illustrated) on which the shapes corresponding to the rows 3 of a plurality of thin rubber pieces 2 are inscribed is pressed onto the rubber laminated layer 1 in a heated state. Thereby, by changing the inscribed shapes, the size, thickness, etc. of the rubber pieces 2 are able to be changed.

Figure 3:
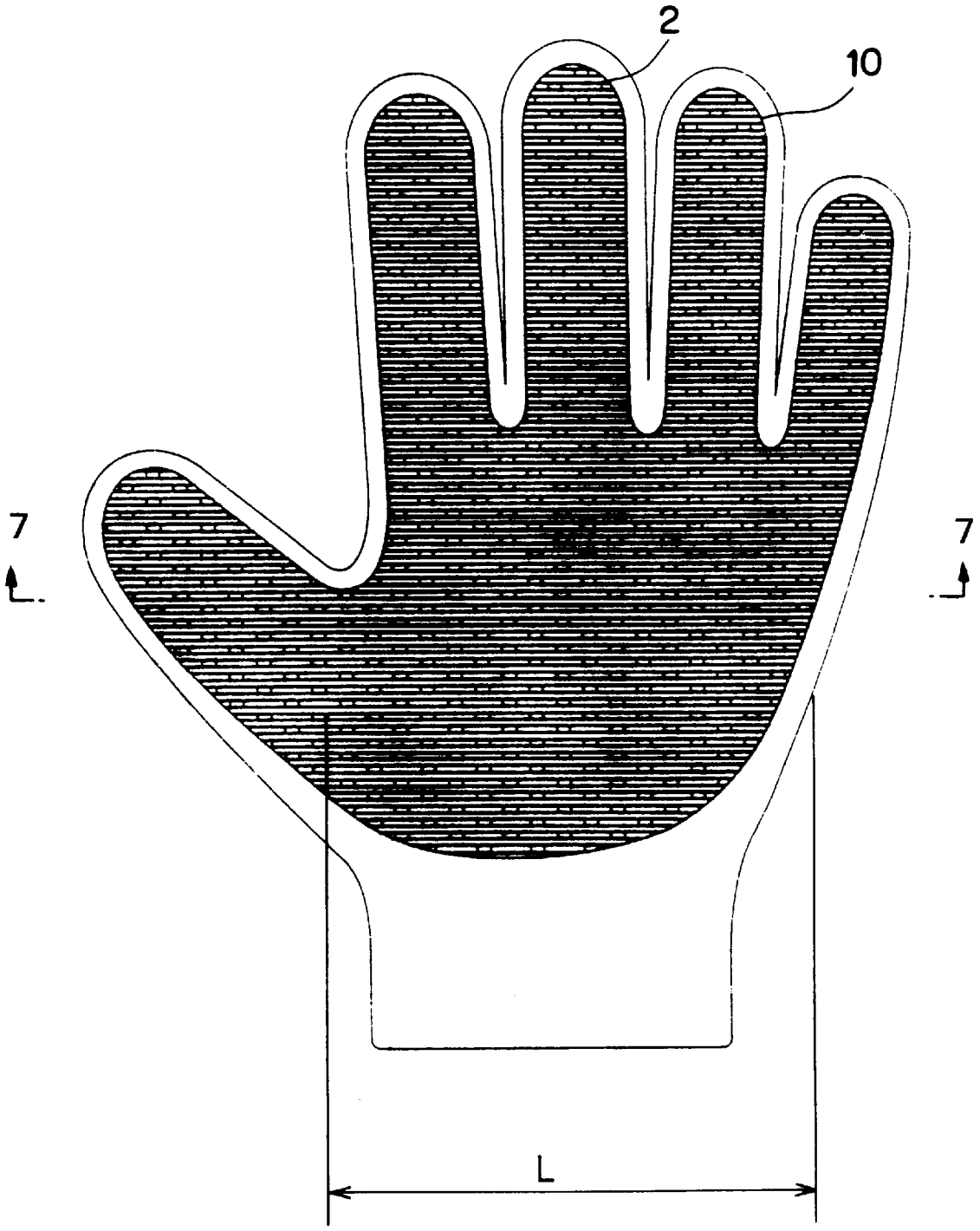
FIG. 3 is a front elevational view showing slip-stop rubber sheet lined work gloves according to the preferred embodiment of the invention.
Figure 4A:
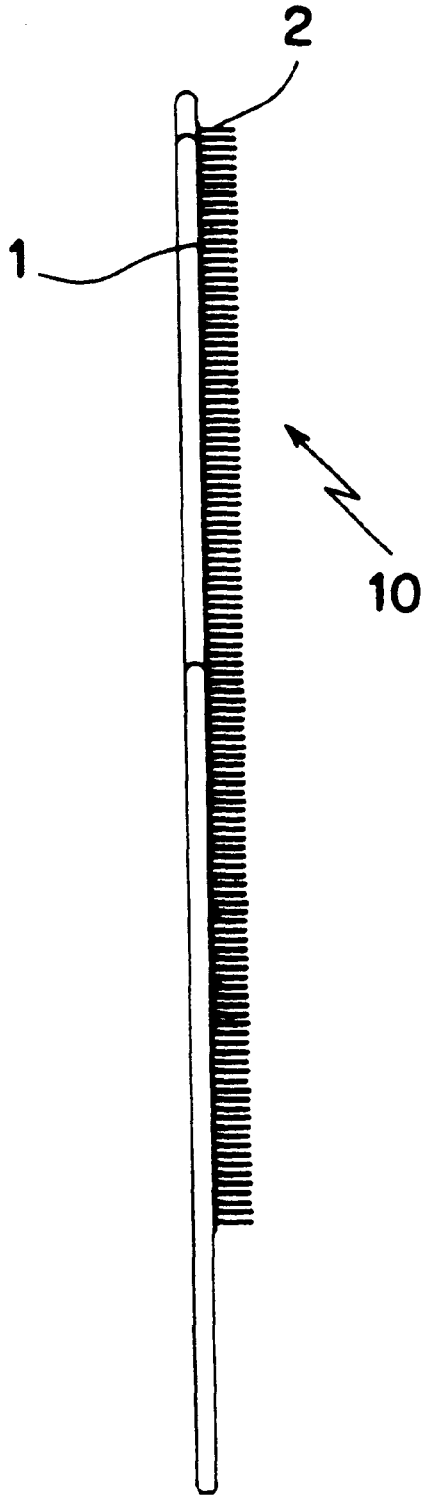
FIGS. 4(*a*) and 4(*b*) are side elevational views of slip-stop rubber sheet lined work gloves shown in FIG. 3, wherein FIG. 4(*a*) is the left side elevational view thereof, and FIG. 4(*b*) is the right side elevational view thereof.
Figure 4B:
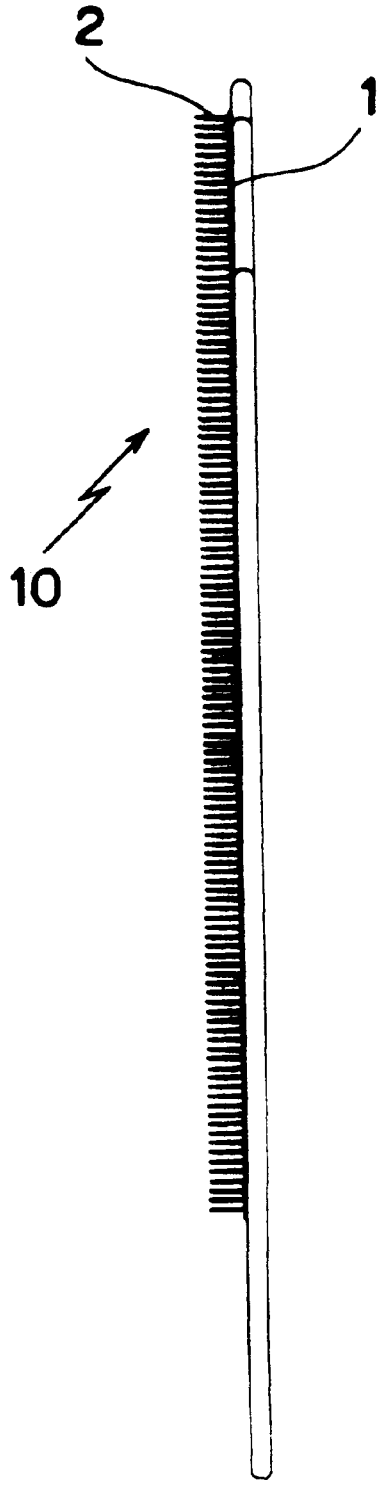
Figure 5:
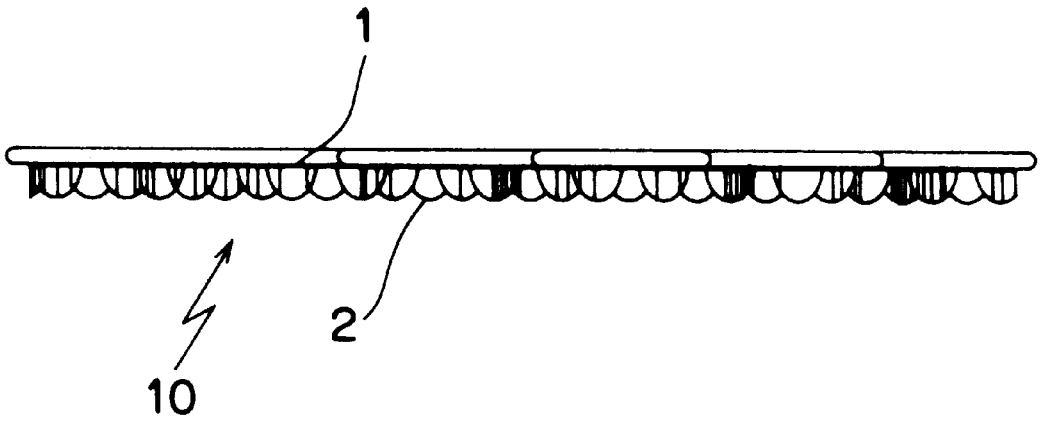
FIG. 5 is a plan view of slip-stop rubber sheet lined work gloves shown in FIG. 3.
Figure 6:
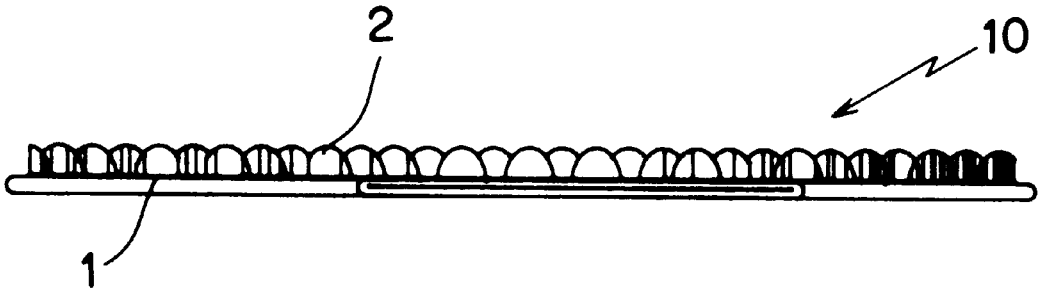
FIG. 6 is a bottom view of slip-stop rubber sheet lined work gloves shown in FIG. 3.
Figure 7:
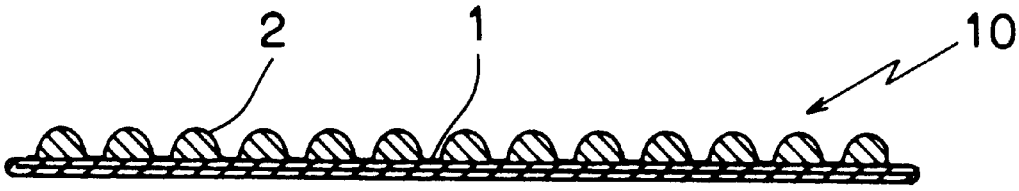
FIG. 7 is a cross-sectional view taken along the line 7—7 in FIG. 3.

Next, with reference to FIG. 3 through FIG. 7, a description is given of slip-stop rubber sheet (10) lined work gloves according to the preferred embodiment of the invention. FIG. 3 is a front elevational view showing the slip-stop rubber sheet lined work gloves according to the preferred embodiment of the invention, FIGS. 4(*a*) and 4(*b*) are side elevational view thereof, FIG. 5 is a plan views thereof, FIG. 6 is a bottom view thereof, and FIG. 7 is a cross-sectional view taken along the line 7—7 in. FIG. 3.

The abovementioned work gloves are such that the above slip-stop rubber sheet is pressure-fit and formed on the palmar surface of gloves. As used herein, the term "pressure-fit" means that gum may be impregnated into the textile of the gloves without the use of any adhesive agent, or may be adhered by an adhesive agent. Furthermore, the gloves may be knitted gloves, natural gum gloves, or synthetic rubber gloves.

The slip-stop rubber sheet 10 is pressure-fit so that the X direction of the slip-stop rubber sheet 10 is made coincident with the direction parallel to the direction of the palmar width L of the gloves, that is, the same is made coincident with the cross direction of the gloves, whereby since the X direction of the slip-stop rubber sheet is made coincident with the bending direction of a hand of a user (worker) wearing the gloves, there is less resistance when bending the hand.

Furthermore, since rows of a plurality of rubber pieces which will act as slip stoppers are erected on the surface of the rubber laminated layer of a slip-stop rubber sheet as described above, an excellent slip-stop function is able to be fully displayed even though the thickness of the rubber laminated layer is made only about 0.45 mm which is about half the conventional thickness.

As described above, according to the slip-stop rubber sheet of the invention, it is possible to obtain an excellent slip-stop effect with rubber pieces erected on the surface of the rubber laminated layer. Therefore, it is possible to attach such a slip-stop rubber sheet onto necessary sections of, for example, work gloves or socks or to directly use the same as slip-stop mats.

According to slip-stop rubber sheet lined work gloves of the invention, to which the abovementioned slip-stop rubber sheet is applied, since there is less resistance when bends his or her hands of a user (worker) wearing the same, and since it is possible to reduce the thickness of the rubber laminated layer to about 0.45 mm which is about half the conventional thickness thereof, work gloves which are very flexible, which are easily fit to a hand and easy to use, can be achieved. In particular, such work gloves are more suitable for general light work such as do-it-yourself home improvement gardening, etc. than heavy work gloves having a conventional thick rubber laminated layer.

What is claimed is:

1. A slip-stop rubber sheet comprising a plurality of individually bendable rubber pieces formed on a surface of a rubber layer in an XY plane at an appointed interval in the Y direction, wherein said rubber pieces are erected in a plurality of rows such that said rubber pieces extend so as to roughly constitute waveforms in the X direction and such that said rubber pieces are bendable in the Y direction relative to the surface of the rubber layer.

2. The slip-stop rubber sheet of claim 1, wherein said plurality of rubber pieces are thinner in the Y direction than in the X direction.

3. The slip-stop rubber sheet of claim 2, wherein said slip-stop rubber sheet has a thickness of about 0.45 mm in a Z direction perpendicular to the XY plane.

4. The slip-stop rubber sheet of claim 2, wherein said plurality of rubber pieces are formed on the surface of said rubber layer such that if said rubber pieces are subject to a force from a first side in the Y direction, said rubber pieces are bent to a second side in the Y direction so as to form convex and concave surfaces.

5. A slip-stop rubber sheet lined work glove comprising a slip-stop rubber sheet having a plurality of individually bendable rubber pieces formed on a surface of a rubber layer in an XY plane at an appointed interval in the Y direction, wherein said rubber pieces are erected in a plurality of rows such that said rubber pieces extend so as to roughly constitute waveforms in the X direction and such that said rubber pieces are bendable in the Y direction relative to the surface of the rubber layer, wherein said rubber pieces each have substantially flat side surfaces linearly extending in the z direction, and wherein said slip-stop rubber sheet is pressure-fit onto a palmar surface of a glove and laminated thereon in such a manner that the X direction of said slip-stop rubber sheet is made coincident with a cross direction parallel with a width direction of a palmar width of the glove.

6. The slip-stop rubber sheet lined work glove of claim 5, wherein said plurality of rubber pieces are thinner in the Y direction than in the X direction.

7. The slip-stop rubber sheet lined work glove of claim 6, wherein said slip-stop rubber sheet has a thickness of about 0.45 mm in a Z direction perpendicular to the XY plane.

8. The slip-stop rubber sheet lined work glove of claim 6, wherein said plurality of rubber pieces are formed on the surface of said rubber layer of said slip-stop rubber sheet such that if said rubber pieces are subject to a force from a first side in the Y direction, said rubber pieces are bent to a second side in the Y direction so as to form convex and concave surfaces.

9. The slip-stop rubber sheet lined work glove of claim 5, wherein said glove is one of a knitted glove, a natural gum glove, and a synthetic rubber glove.

10. The slip-stop rubber sheet lined work glove of claim 5, wherein said slip-stop rubber sheet is pressure-fit onto the palmar surface of said glove by impregnating gum into a textile of the glove.

* * * * *